US011420434B2

(12) United States Patent
Schwiertz et al.

(10) Patent No.: US 11,420,434 B2
(45) Date of Patent: Aug. 23, 2022

(54) CYLINDER WITH MOVABLE PIN, AND MOUNTING AND DISMOUNTING METHOD

(71) Applicant: FLINT GROUP GERMANY GMBH, Stuttgart (DE)

(72) Inventors: Martin Schwiertz, Emsburen (DE); Markus Schlapschi, Legden (DE); Uwe Müller, Ahaus (DE); Klaus Bennink, Vreden (DE)

(73) Assignee: FLINT GROUP GERMANY GMBH, Stuttgart (DE)

( * ) Notice: Subject to any disclaimer, the term of this patent is extended or adjusted under 35 U.S.C. 154(b) by 0 days.

(21) Appl. No.: 17/282,011

(22) PCT Filed: Oct. 15, 2019

(86) PCT No.: PCT/EP2019/077921
§ 371 (c)(1),
(2) Date: Apr. 1, 2021

(87) PCT Pub. No.: WO2020/078979
PCT Pub. Date: Apr. 23, 2020

(65) Prior Publication Data

US 2021/0354440 A1 Nov. 18, 2021

(30) Foreign Application Priority Data

Oct. 17, 2018 (EP) ..... 18201054

(51) Int. Cl.
*B41F 27/12* (2006.01)
*B41F 30/06* (2006.01)
(Continued)

(52) U.S. Cl.
CPC ..... *B41F 13/16* (2013.01); *B41F 27/005* (2013.01); *B41F 27/105* (2013.01); *B41F 27/14* (2013.01);
(Continued)

(58) Field of Classification Search
None
See application file for complete search history.

(56) References Cited

U.S. PATENT DOCUMENTS 2,165,233 A * 7/1939 Curtis ..... B41F 27/1218 101/415.1
2,782,712 A * 2/1957 Claff ..... B41F 7/02 101/409
5,209,163 A * 5/1993 Banike ..... B41F 27/02 101/415.1

FOREIGN PATENT DOCUMENTS

EP 0510744 A1 10/1992
EP 0782919 A1 7/1997
(Continued)

OTHER PUBLICATIONS

International Search Report and Written Opinion for the International Patent Application No. PCT/EP2019/077921, dated Nov. 7, 2019, 14 pages.
(Continued)

*Primary Examiner* — Leslie J Evanisko
(74) *Attorney, Agent, or Firm* — KDB Firm PLLC

(57) ABSTRACT

A cylinder is arranged to receive one or more hollow cylinders on an outer surface of the cylinder. The cylinder has at least one movable stop with at least one movable element. In an idle position the at least one movable element does not protrude beyond the outer surface of the cylinder and allows hollow cylinders to be slid over the cylinder, and in an active position it protrudes beyond the outer surface of the cylinder and acts as a mechanical stop for hollow cylinders. The at least one movable element can be moved from the idle position to the active position, and vice versa, by means of a rotary movement. A method for positioning a hollow cylinder on a cylinder of this kind.

20 Claims, 3 Drawing Sheets

(51) Int. Cl.

| | |
|---|---|
| ***B41F 13/16*** | (2006.01) |
| ***B41F 27/00*** | (2006.01) |
| ***B41F 27/10*** | (2006.01) |
| ***B41F 27/14*** | (2006.01) |

(52) U.S. Cl.
CPC ..... *B41P 2227/11* (2013.01); *B41P 2227/21* (2013.01); *B41P 2227/41* (2013.01)

(56) References Cited

FOREIGN PATENT DOCUMENTS

| | | | |
|---|---|---|---|
| EP | 3275656 | A1 | 1/2018 |
| WO | 2011101500 | A1 | 8/2011 |
| WO | 2016135552 | A1 | 9/2016 |

OTHER PUBLICATIONS

International Preliminary Examination Report for the International Patent Application No. PCT/EP2019/077921, dated Jan. 13, 2021, 12 pages.

* cited by examiner

CYLINDER WITH MOVABLE PIN, AND MOUNTING AND DISMOUNTING METHOD

This is a national stage application filed under 35 U.S.C. § 371 of pending international application PCT/EP2019/077921, filed Oct. 15, 2019, which claims priority to European Patent Application No. 18201054.6, filed Oct. 17, 2018, the entirety of which applications are hereby incorporated by reference herein.

The invention relates to a cylinder which is arranged to receive one or more hollow cylinders on an outer surface of the cylinder. Further aspects of the invention relate to an arrangement comprising such a cylinder and a hollow cylinder arranged thereon, as well as a method for positioning a hollow cylinder on the cylinder and for removing a hollow cylinder from the cylinder.

INTRODUCTION

In the printing industry, sleeves and adapters are largely used in the flexographic printing process. In flexographic printing, ink is transferred to a printing medium via a printing plate by means of compressive strength. In addition to relief printing and gravure printing, flexographic printing is one of the main printing processes in the packaging industry in particular. It is characterised by its flexible printing plate and can therefore be used for printing paper, films and fibrous materials. In addition, it can be used for a range of ink systems, thus allowing more widespread use.

The various embodiments of flexographic printing machines are individually adapted to the respective application. These machines can be divided into the main groups of multi-cylinder and central cylinder printing machines. Individual print repeats can be achieved by using steel cylinders with a wide range of diameters. In principle, adapters are mounted on a steel cylinder for bridging repeats. A sleeve is then mounted on the adapter. Finally, a printing plate or alternatively a printing block, is then attached to the sleeve in what is known as the pre-assembly.

DESCRIPTION OF THE INVENTION

The invention is a cylinder or hollow cylinder on which further hollow cylinders (e.g. sleeves) of a different length can be mounted in the same position, without a tool being required to change the length or without the general functions of the cylinder being adversely affected. In general, it is a simple system which can be implemented cost-effectively without high consequential costs for the customer. A further cost advantage for the customer is firstly that such a cylinder is cheaper to procure than, for example, three cylinders of different lengths, and secondly that there are no storage costs. It is also possible to convert existing standard cylinders to this new type.

In addition to the ability to change the stop without any tools while maintaining the same register accuracy, the multi-length cylinder, which can be used without tools, is characterised by the fact that it has at least one pre-installed movable element. In the idle position, the at least one movable element is located in a recessed pocket underneath the surface of the cylinder to allow hollow cylinders to slide over this cylinder. In the active state, the at least one movable element is located in an active position in which it protrudes beyond the surface of the cylinder and holds the hollow cylinder in position. The at least one movable element is therefore configured so as to be relatively stable. A switch between the idle position and the active position can preferably be effected by folding the at least one movable element. In addition to limiting the folding angle, an additional end stop can also serve to increase stability. Furthermore, the at least one movable element is preferably prevented, by means of a locking device, from independently changing position without active intervention.

A cylinder is accordingly proposed which is arranged to receive one or more hollow cylinders on an outer surface of the cylinder. The cylinder has at least one movable stop with at least one movable element, wherein the at least one movable element does not, in an idle position, protrude beyond the outer surface of the cylinder and allows hollow cylinders to slide over the cylinder and, in an active position, protrudes beyond the outer surface of the cylinder and acts as a mechanical stop for hollow cylinders. It is intended that the at least one movable element can be moved from the idle position to the active position, and vice versa, by means of a rotary movement. The cylinder can be a solid cylinder or a hollow cylinder, for example a plate cylinder, a hollow cylinder or an adapter sleeve. Preferably, the cylinder is an adapter sleeve.

Such an adapter sleeve has a sleeve body which is substantially identical to that of the adapter sleeves known from the prior art. The sleeve body has a tubular shape or a hollow circular cylinder shape and preferably comprises a malleable base sleeve, as seen from the inside looking outwards, an optional malleable intermediate layer, and a top layer. In particular, the base sleeve, the optional intermediate layer and the top layer are substantially identical to those of the adapter sleeves from the prior art.

The malleable base sleeve can be constructed from one layer or from a plurality of layers, but preferably it consists of one layer. The malleable base sleeve can consist of a flexible ceramic layer, a metal layer made of aluminium or nickel, for example, a metal alloy, a reinforced or unreinforced plastic, or combinations thereof. If metals, alloys and ceramic are used, these preferably take the form of a partial layer, in particular the form of a perforated plate, a woven wire cloth, or combinations of a plurality of these materials. Reinforced plastics reinforced with fibres, fillers, or combinations thereof, are preferably used. Metal, glass and/or carbon fibres are particularly favoured as fibres, but plastic fibres can also be used. Carbon fibres, glass fibres and/or plastic fibres are preferably used. In terms of plastic fibres, polyester, polyamide and polyaramids are preferred. Fillers in the form of inorganic or organic particles can be incorporated. Materials used as inorganic fillers can include carbonates, silicates, sulphates or oxides, such as calcium carbonates or calcium sulphates, bentonites, titanium dioxides, silicon oxides, quartz, or combinations thereof, although calcium carbonate, calcium sulphate, titanium dioxide and silicon dioxide are preferred. Fibres are preferably used for reinforcement, and glass and/or carbon fibres are particularly preferably used. These fibres be used in the form of woven fabrics, non-woven fabrics, different layers of majoritarily parallel fibres, or combinations thereof.

Plastics with a glass transition temperature above 50° C., preferably above 70° C. and particularly preferably above 80° C., come under consideration as plastics or plastic mixtures. To simplify the manufacture of the base sleeve, thermally curable and/or UV-curable mixtures are preferably used with which the fibres are impregnated such they are embedded in the plastic matrix. Epoxides, unsaturated polyester/styrene mixtures, polyesters, polyethers and polyurethanes are preferably used as thermally curable mixtures. Epoxides and unsaturated polyester/styrene mixtures are preferably used.

Both rigid and malleable materials which can preferably be deformed and then return to their initial shape again, in other words which have resilience, are used as the optional malleable intermediate layer. To this end, a range of polymers such as natural and synthetic rubbers, elastomers and foams can be used. The foams can have open or closed pores, or combinations thereof. Closed pores are preferably used. The foams are made from polymers, such as polyethylene, polypropylene, polystyrene, polyesters and polyurethanes. A polyurethane foam is preferably used as the foam.

Rigid materials, preferably metals, alloys, ceramics, glasses, polymers such as polyethers, polyesters, polyurethanes, epoxides, and generally fibre-reinforced or foamed plastics, or combinations thereof, are used for the top layer, with polyurethanes being especially particularly preferred. The surface of the top layer can be rough or smooth, but preferably it is as smooth as possible to allow easy sliding on of hollow cylinders. The top layer is preferably dimensionally stable or rigid.

The materials of the layers are preferably chosen so that they are impermeable to gases such that a build-up of pressure is possible and the pressure can be maintained over a period of several days or hours. In some cases, it may also be necessary to configure the layers so that they are electrically conductive (see for example EP1346846A1, EP1144200A1, EP2051856A1, EP1263592A1) in order to prevent electrostatic charges.

The thickness of the base layer ranges from 0.3 mm to 8 mm, preferably from 0.5 mm to 5 mm, particularly preferably from 2.9 mm to 4.5 mm. The thickness of the optional intermediate layer ranges from 0.2 mm to 125 mm, preferably from 10 mm to 100 mm. The thickness of the top layer ranges from 0.5 mm to 10 mm, preferably from 1 mm to 3 mm, The wall thickness of the adapter sleeve ranges from 8 mm to 150 mm, preferably from 15 mm to 75 mm. The wall thickness of the adapter sleeve is the total of the wall thicknesses of all layers of the sleeve.

The inside diameter of the adapter sleeve according to the invention ranges from 10 mm to 1000 mm, preferably from 40 mm to 630 mm, particularly preferably from 85 mm to 275 mm. The outside diameter of the adapter sleeve according to the invention ranges from 20 mm bis 2000 mm, preferably from 100 mm to 700 mm, particularly preferably from 125 mm to 300 mm.

The adapter sleeve can have one or more gas inlets and outlets which are connected to a gas distribution system. Such an adapter sleeve is known from EP 3 243 660 B1, for example.

The one gas inlet or plurality of gas inlets is or are connected to a gas distribution system or plurality of gas distribution systems which distributes or distribute the gas in the adapter sleeve. The gas distribution system can consist of channels or tubes which run in or between the base layer and top layer, in one intermediate layer or in a plurality of intermediate layers, between different layers, or in combinations thereof. The first gas distribution system is preferably configured in the form of one or more channels which are worked into the surface or core of a layer, for example by means of drilling, milling, engraving, machining, cutting, or combinations thereof. The gas distribution system is connected to one or more gas outlets, which ends in an external outer surface and therefore in the surface of the top layer. The gas outlets can be configured in the form of one or more round, slit-shaped or square openings in the top layer or as a porous material or a material with a high portion of openings. A gas outlet is preferably located, as seen in the longitudinal direction of the adapter sleeve, in the first third of one side of the adapter sleeve and this side is preferably the side facing an operator. In a further embodiment, a gas distribution system can have at least one cavity which is arranged, when exposed to pressurised gas, to transfer pressure from inside onto the malleable base sleeve such that at least in a partial area of the adapter sleeve the inside diameter of the sleeve body is reduced by a deformation of the base sleeve.

In an embodiment of the adapter sleeve, a gas connection is arranged on a front side of the adapter sleeve as a gas inlet. In this case, the adapter sleeve is suppled with gas so that sliding onto another cylinder, such as, for example, a plate cylinder which does not provide gas for creating a gas cushion, is made possible. The gas connection can be configured in the form of a quick-release coupling, a gas olive, a pipe or a pipe connected to a tube with a clamp. The gas connection is preferably a quick-release coupling.

In a further embodiment of the adapter sleeve, the at least one gas inlet is arranged on the inside of the sleeve body and is arranged for connecting to gas outlets on the external outer surface of another cylinder, for example a plate cylinder. This arrangement allows gas provided by the other cylinder, for example a plate cylinder, on which the adapter sleeve is placed, to reach the surface of the adapter sleeve and to be used to mount one or more further hollow cylinders.

The gas inlet placed on the inside of the sleeve body and therefore on the base layer of the sleeve body is used to admit gas which is provided by the other cylinder onto which the adapter sleeve is to be slid to the adapter sleeve. The gas inlet can be configured in the form of one or more round, slit-shaped or square openings in the top layer, as a porous material or as a material with a high portion of openings.

The gas outlet is preferably located in the first third, as seen in the longitudinal direction of the adapter sleeve, of one side of the adapter sleeve, and this side is preferably the side facing an operator.

The adapter sleeve preferably comprises a gas control unit which is arranged to release and/or block the flow of gas from the gas inlet to the gas distribution systems.

Through different settings of the gas control unit, it is possible to steer the gas in a targeted manner and thus create different functions. This allows the adapter sleeve to be slid onto a cylinder with or without its own gas supply, a further hollow cylinder to be mounted on the adapter sleeve or the adapter sleeve to be clamped onto another cylinder present, for example a plate cylinder.

The gas control unit can consist of one or more components and can either be integrated into the adapter sleeve or be arranged on the outside of the adapter sleeve. The gas control unit is preferably arranged inside the adapter sleeve.

The gas outlet is preferably configured as boreholes arranged around the circumference of the sleeve or gas-permeable porous areas arranged around the circumference of the sleeve. Porous areas running axially are also possible.

The gas outlets can consist of one or more round, slit-shaped or square openings or boreholes in the top layer or in the base layer. However, the openings can also be configured in the form of porous areas which are added to the top layer or to the base layer and, where applicable, to the intermediate layer and comprise porous materials.

Porous materials are understood to mean materials where the pores make up a volume fraction ranging from 1% to 50%, particularly preferably from 5% to 40% and especially particularly from 10% to 30% of the material. The specified percentage relates to the volume fraction of the pores in the volume of the entire porous material. The pore size ranges from 1 μm to 500 μm, preferably from 2 μm to 300 μm, particularly preferably from 5 μm to 100 μm and especially particularly preferably from 10 μm to 50 μm. The pores are preferably distributed homogenously across the volume of the porous material. Examples of such materials include foamed materials with open cells or sintered porous materials.

The porous area is preferably distributed across one porous area or across a plurality of porous areas. A porous area is preferably configured as a ring running around the circumference or a porous area comprises a plurality of partial areas which are configured and arranged in the form of a broken ring running around the circumference. Alternatively or in addition to this, at least one porous area can be provided in the form of a single axial strip or plurality of axial strips. The advantages of using porous materials are that less gas is used and noise nuisance is reduced.

To ensure an exact and reproducible adjustable positioning of different hollow cylinders when placing hollow cylinders on the cylinder according to the invention, at least one movable stop with at least one movable element which performs different functions in at least two positions is used. In an active position, the at least one movable element protrudes beyond the outer surface, stops a movement of the hollow cylinder and acts as a mechanical stop. In an idle position, the at least one movable element is located within or underneath the outer surface of the cylinder and allows a hollow cylinder to slide over and away from the cylinder and thus allows a different positioning in this case.

The at least one movable element is preferably configured as a pin with a circular, elliptic, square, triangular, rectangular or polygonal cross-section. However, other shapes can also be used, such as an element which is arc-shaped on one side, said arc shape matching the shape of the outer surface, thereby giving a more or less continuous surface in the idle position.

The at least one movable element can be moved from the idle position to the active position, and vice versa, by means of a rotary movement. Alternatively, it would also be possible for at least one movable element to be moved from the idle position to the active position, and vice versa, by means of a translational movement.

When using at least one rotatably configured movable element, this element is preferably rotatable around an axis of rotation perpendicular to a longitudinal axis of the cylinder. However, it is also possible to arrange the axis of rotation within a different angle. If the axis of rotation runs parallel to the cylinder axis, it is possible to configure the movable element so that in the idle position it forms a more or less seamless, uniform surface with the outer surface of the cylinder. In the case of, in particular, an elongate movable element, such as a pin for example, it is also preferable that a bearing arrangement of the movable element is configured such that a longitudinal axis of the movable element is aligned radially to the cylinder when the movable element is in the active position.

To connect the at least one movable element, a fastening can be inserted which preferably comprises the movable element and the means for moving the movable element from the idle position to the active position, and vice versa. The fastening is preferably connected to the cylinder in a bonded, frictional and/or positive fit, with a positioning part being inserted between the fastening and cylinder as required. The fastening is fastened to the cylinder by means, for example, of connecting components such as a screw or rivet at least, or it is connected to the cylinder by means of bonding, welding, magnetism or press-fitting in a recess in the surface of the cylinder.

The fastening is preferably connected to the cylinder by means of a positioning part. To this end, the positioning part preferably comprises fastening points in which the means of fastening engages to connect to the fastening. The positioning part can be connected to the cylinder in a bonded, frictional and/or positive fit, for example. The positioning part is connected to the cylinder by means, for example, of connecting components such as a screw or rivet at least, or it is connected to the cylinder by means of bonding, welding, magnetism or press-fitting in a recess in the surface of the cylinder.

The fastening and, where present, the positioning part engage in the surface of the cylinder in a recess or pocket, thus ensuring that hollow cylinders are not prevented from sliding over the cylinder by the fastening or positioning part when the at least one movable element is in the idle position. The recess preferably has a depth, as seen from the surface, in other words the outer surface, ranging from 0.5 mm to 20 mm. The surface of the recess is preferably adapted to the size of the movable element or elements to be received in the recess. It is preferable if the shape and size of recess is chosen such that there is a seamless transition between a surface of the movable element and the outer surface when the element is in the idle position. A transition is deemed to be seamless in this context if any gap present between a surface of the movable element and the outer surface is less than 1 mm. Furthermore, the recess can be configured so that it is deeper than the movable element in at least one place to provide a recessed grip for manual actuation of the movable element.

A movable element configured so as to be rotatable, such as a movable pin, is preferably mounted by means of a stud in a fastening. Either the stud can be fixedly connected to the movable element and the stud can be movably mounted in the fastening, or conversely the movable element can be mounted so that it is movable relative to the stud and the stud is fixedly connected to the fastening. Alternatively, the stud can be movably mounted in the fastening and the movable element is also mounted movably in the stud.

The connection between the at least one movable element and the cylinder is preferably configured detachably. To this end, the fastening and/or the positioning part is fastened to the cylinder with detachable fastening means, such as screws. This allows individual movable elements or parts thereof, such as a positioning part, a fastening, a stud, a thrust piece or even parts of these to be replaced as required.

The cylinder preferably has at least one fixed stop with at least one fixed element protruding beyond the outer surface and serving as a mechanical stop for hollow cylinders. This fixed stop is particularly used if when positioning hollow cylinders a change of position of the hollow cylinder on the cylinder is not required. The fixed stop with the at least one fixed element can be used, for example, in an area at the end of the cylinder to prevent the hollow cylinder from moving beyond the edge of the cylinder and can act as a safety measure.

The at least one fixed element is preferably configured as a pin, as a raised edge, as a segment of a raised edge, as a raised ring or as a segment of a raised ring. Furthermore, combinations including a recess, in the form for example of a circumferential groove, a broken circumferential groove, a single borehole or plurality of boreholes, with corresponding counterparts can be used in the slide-on hollow cylinder, wherein the corresponding counterparts are arranged in a slide-on hollow cylinder. Elements that can be used as counterparts in the slide-on hollow cylinder include, for example, submersible elements, pins, springs, stop edges, or combinations thereof.

The at least one movable element is preferably configured as a pin, as a segment of a raised ring, or as a segment of a raised edge. In the case of a segment of a raised ring or a raised edge, the at least one movable element is preferably configured so that the outer radius of the segment is the same as that of the cylinder, giving a more or less continuous surface in the idle position.

An end stop is preferably provided for the at least one movable element, which end stop defines the exact position and/or orientation of the movable elements in the active position at least. For example, an end stop is provided for a rotatable movable element, such as a rotatably mounted pin, and limits the rotary movement such that a rotary movement starting from the idle position and moving towards the active position ends in a position in which a longitudinal axis of the movable element is oriented radially relative to the cylinder. Where the axis of rotation of the element is arranged perpendicularly to the cylinder axis, the longitudinal axis of the movable element in the active position deviates in an axial direction by less than 30° beyond the 90° position, preferably by less than 20° beyond the 90° position, particularly preferably by less than 10° beyond the 90° position, especially particularly by less than 5° and most preferably by less than 1° beyond the 90° position. A longitudinal axis of the at least one movable element in the active position preferably deviates from an orientation perpendicular to the longitudinal axis of the cylinder by less than 30°. This can be achieved, for example, by the provision in a fastening of a corresponding end stop which prevents movement of the movable element beyond the 90° position. One option is, for example, an appropriately positioned stud, stop edge, screw, or similar combinations thereof.

Where the axis of rotation of the at least one movable element is arranged parallel to the cylinder axis, a deviation from the radial arrangement by up to 60°, preferably by up to 50°, particularly preferably by up to 30°, especially particularly preferably by up to 20°, can also be applied in both directions.

To achieve an adequate stop effect, the at least one movable element should protrude beyond the outer surface of the cylinder in the active position. The at least one movable element in the active position and/or the at least one fixed element preferably protrudes beyond the surface of the cylinder within a range of 0.1 mm to 100 mm, preferably within a range of 0.1 mm to 10 mm, particularly preferably within a range of 0.1 mm to 5 mm and especially preferably within a range of 0.1 mm to 3 mm.

To achieve a particularly sturdy stop effect, a plurality of movable or fixed elements can be arranged on the cylinder in a movable or fixed stop. The at least one movable stop comprises anything in the range of two to ten movable elements distributed around the outer surface of the cylinder along a circumferential line and/or the at least one fixed stop comprises anything in the range of two to ten fixed elements distributed around the outer surface of the cylinder along a circumferential line. Preferably 2 to 8 movable or fixed elements are used, particularly preferably 2 to 6 movable or fixed elements, especially particularly 2 to 4 movable or fixed elements and most particularly 2 movable or fixed elements. The elements can be spaced at irregular or regular intervals along the circumferential line or in combinations of irregular and regular spacings. The circumferential line is preferably aligned such that all movable or fixed elements are at the same height, as seen along a longitudinal axis of the cylinder.

In order to be able to position as large a number of different hollow cylinders precisely, it is possible to use a plurality of movable or fixed stops. These movable or fixed stops can in turn comprise one or more movable or fixed elements. At least two movable stops or at least one fixed stop and one movable stop are therefore preferably arranged on the outer surface, distributed along the length of the cylinder. The movable or fixed elements of the stops can be arranged in a line which runs parallel to or at any angle to the cylinder axis or can be arranged completely as desired. A linear arrangement is preferably chosen. It is also possible to distribute two or more movable or fixed elements along a circumferential line around the outer surface of the cylinder and to combine them with a linear or any other arrangement of further elements. A non-linear arrangement of at least two movable elements is particularly advantageous if the spacing of the stop positions along the line running parallel to the cylinder axis is smaller than the length of the fastening. The number of movable or fixed elements is not limited and is based on the number of stops required.

The at least one movable element and/or the at least one fixed element is preferably made from a material selected from a metal, alloy, plastic, fibre-reinforced plastic, ceramic or glass. A metal, alloy or rigid plastic is preferably used. In particular, steels, stainless steels, reinforced rigid plastics, or combinations thereof, are used. In particular, the same materials as for the surface of the cylinder are suitable for the at least one movable or fixed element.

To prevent unwanted changes in the position of the movable element, it is advantageous if this is prevented by an appropriate device. The cylinder therefore preferably further comprises at least one locking device which is arranged to fix the at least one movable element in the active position and/or in the idle position. If a locking device is used, a part of the locking device such as a spring-loaded thrust piece can be arranged on the positioning part, wherein the counterpart for the locking device is preferably located directly on the movable element. The locking device preferably comprises a spring-loaded thrust piece, a spring (steel sheet), a spiral spring, a compressible plastic, rubber, gel, or combinations thereof. A spring-loaded thrust piece or spring (steel sheet) is preferably used as a locking device.

The spring-loaded thrust piece preferably has a ball head which is arranged to act on the movable element. The movable element is therefore preferably provided with a corresponding counterpart for the ball head; for example, the movable element has a preferably ball-shaped recess at the end facing the cylinder axis in the active position.

In order to move the at least one movable element between the active position and the idle positions, all methods commonly known to the skilled person can be used, such as pneumatic, electric, magnetic, mechanical or manual methods. The at least one movable element preferably comprises a means for pneumatic movement, an electric drive or a means for manual movement. The means for pneumatic movement are configured as a pneumatic cylinder, for example. An electric drive is configured as, for example, an electric motor such as a servomotor, or as an electromagnet which acts on the movable element. The means for manual movement include, for example, recessed grips in the outer surface of the cylinder and/or recesses in a fastening used to mount the movable element, which recessed grips or recesses allow the movable element to be gripped. In addition or alternatively, the means for manual movement can comprise handles with which the movable element can be gripped and manually moved.

Manual movement is preferably possible by means of direct gripping of the movable element. To this end, the movable element is directly accessible from the outside without the use of aids, for example by providing corresponding recessed grips or recesses in the outer surface of the cylinder and/or a fastening.

If the cylinder is configured as an adapter sleeve or a plate cylinder with a gas connection, the gas can be delivered to pneumatic cylinders via a gas distribution system. By controlling the gas distribution system appropriately, the movable elements of a movable stop of the cylinder can then be moved to the active position or idle position in a targeted manner.

The proposed modular structure of the cylinder with movable elements also allows easy retrofitting of existing cylinders with a movable stop of this kind. To this end, one or more recesses are created in the outer surface of the cylinder and one movable element is arranged in each recess and connected to the cylinder.

A method for manufacturing one of the cylinders, described here, according to the invention comprises the following steps:

a. provision of a cylinder;

b. creation of at least one recess in the outer surface of the cylinder;

c. provision of at least one movable element; and d. fastening of the at least one movable element to the cylinder in the at least one recess.

The at least one recess can be produced by means of milling, for example. A separate recess is preferably produced for each movable element. Alternatively, it is conceivable that a plurality of movable elements may be arranged together in one recess. For example, all movable elements of a movable stop can be arranged in a single recess configured in the form of a circumferential groove.

As an option, a fastening can be used which can contain the movable element and corresponding means of movement. The fastening is preferably connected to the cylinder in a bonded, frictional and/or positive fit, with a positioning part being inserted between the fastening and cylinder as required. The fastening is fastened to the cylinder by means, for example, of connecting components such as a screw or rivet, or is connected to the cylinder by means of bonding, welding, magnetism or press-fitting in a recess in the surface of the cylinder.

The fastening is preferably connected to the cylinder by means of a positioning part. To this end, the positioning part preferably comprises fastening points in which the means of fastening can engage to connect to the fastening. The positioning part can be connected to the cylinder in a bonded, frictional and/or positive fit, for example. The positioning part is connected to the cylinder by means, for example, of connecting components such as a screw or rivet, or is connected to the cylinder by means of bonding, welding, magnetism or press-fitting in a recess in the surface of the cylinder. The positioning part can be manufactured using all standard methods, but preferably it is manufactured in an additive method.

The cylinder, described above, according to the invention is suitable for a large number of applications, in particular for mounting and machining cylinders and hollow cylinders, as frequently seen in the printing sector. The cylinder according to the invention is therefore preferably configured as an assembly cylinder for machining hollow cylinders or as an adapter cylinder for mounting hollow cylinders, in particular printing sleeves.

A further aspect of the invention relates to an arrangement of cylinders containing one of the cylinders, described above, according to the invention, wherein at least one further hollow cylinder is arranged on the cylinder according to the invention and wherein at least one edge of the further hollow cylinder is touching a movable element of the cylinder according to the invention in the active position. The cylinder according to the invention with movable elements is, for example, an assembly cylinder for machining hollow cylinders, a plate cylinder or an adapter cylinder for mounting printing sleeves on a plate cylinder. The further hollow cylinder is, for example, a printing sleeve, a preliminary (sleeve) for a printing sleeve or a core for rolls that can be loaded with web sheet materials.

A further aspect of the invention relates to a method for positioning a hollow cylinder on a cylinder according to the invention, comprising the following steps:

a. provision of a cylinder according to an invention;

b. provision of a further hollow cylinder;

c. adjustment of a selected movable stop by moving at least one movable element of the movable stop to the active position and, where applicable, moving movable elements of non-selected movable stops to the idle position;

d. placement of the further hollow cylinder on the cylinder according to the invention, wherein the further hollow cylinder is slid over an outer surface of the cylinder according to the invention until an edge of the further hollow cylinder touches at least one movable element of the selected movable stop.

The cylinder according to the invention used in the method can be an assembly cylinder for machining hollow cylinders, a plate cylinder or an adapter cylinder for mounting printing sleeves on a plate cylinder. The further hollow cylinder can be, for example, a printing sleeve, a preliminary for the printing sleeve, a sleeve, a core for rolls that can be loaded with web sheet materials, or combinations thereof. The cylinder according to the invention is preferably an adapter cylinder and the further hollow cylinder is a printing sleeve or a preliminary for the printing sleeve.

In step d, the placement of the of the further hollow cylinder can be made easier by creating a gas cushion between the cylinder and hollow cylinder. This is made possible by means of a gas supply of the cylinder and corresponding gas outlet openings in the surface of the cylinder. Alternatively or in addition to this, an air delivery system can be provided in the hollow cylinder, which system has openings on the inside facing the cylinder through which the air can escape and create an air cushion in the hollow cylinder. The hollow cylinder can then be fixed in place on the cylinder, for example by interrupting the gas supply, as a result of which the gas cushion disappears and the hollow cylinder is fastened. Another option is to equip the hollow cylinder with a fastening mechanism and to then use this mechanism. Such a fastening mechanism consists, for example, of a hydraulic or pneumatic clamping of the hollow cylinder or the use of set screws. After positioning the further hollow cylinder, the arrangement can be used for flexographic printing, relief printing, gravure printing or pad printing, for example.

After fixing the hollow cylinder in place, further process steps such as rotating, machining, cleaning, or positioning the arrangement can be carried out. Machining in turn can include a number of steps and comprise, for example, milling, grinding, treatment with liquids, gases or plasma, treatment with electromagnetic waves, corna treatment or bonding, for example with adhesive tape and further layers such as printing plates. In particular, the following treatments are possible: ablation of a part of the surface by means of laser radiation, applying inks and transferring the same to a substrate, applying web sheet materials to the hollow cylinder by creating a roll, applying further layers to the hollow cylinder and fixing these in place, or combinations thereof.

A further aspect of the invention relates to a method for removing one of the arrangements described, comprising a cylinder according to the invention and a further hollow cylinder, which method comprises the following steps:

a. provision of an arrangement containing a cylinder according to the invention, wherein at least one further hollow cylinder is arranged on the cylinder according to the invention and wherein at least one edge of the further hollow cylinder touches a movable element of the cylinder according to the invention in the active position;

b. removal of the further hollow cylinder by sliding the further hollow cylinder off the outer surface of the cylinder according to the invention;

c. adjustment of a selected movable stop by moving at least one movable element of the movable stop to the idle position.

The cylinder according to the invention in the method can be, for example, an assembly cylinder for machining hollow cylinders, a plate cylinder or an adapter cylinder for mounting printing sleeves on the plate cylinder. The further hollow cylinder can be, for example, a printing sleeve, a preliminary for the printing sleeve, a sleeve or a core for rolls that can be loaded with web sheet materials. The cylinder according to the invention is preferably an adapter cylinder, the further hollow cylinder a printing sleeve or a preliminary for the printing sleeve.

In step b, the removal of the further hollow cylinder can be made easier by creating a gas cushion between the cylinder according to the invention and the further hollow cylinder. This is made possible by a gas supply to the cylinder according to the invention and the corresponding gas outlet openings in the surface of the cylinder.

DESCRIPTION OF THE FIGURES

Figure 1B:
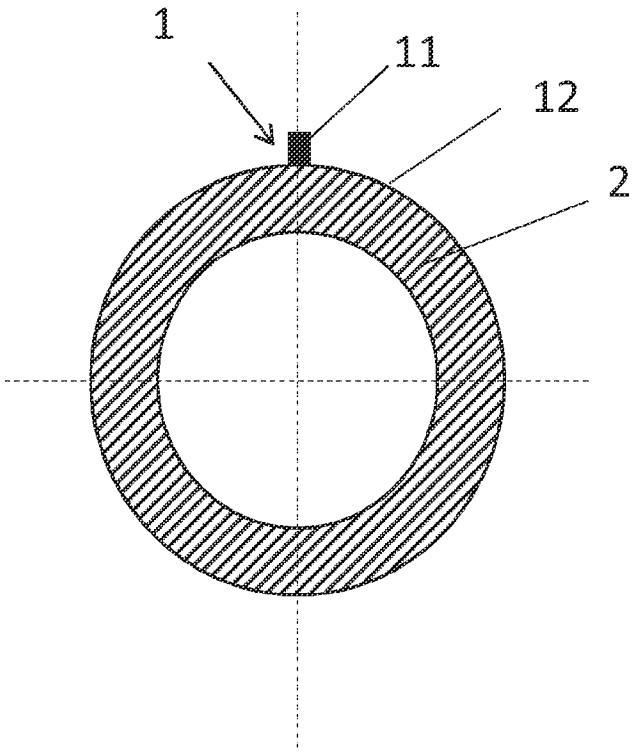
FIG. 1*b* shows a cross-section through the cylinder with a movable stop in the active position.
Figure 1A:
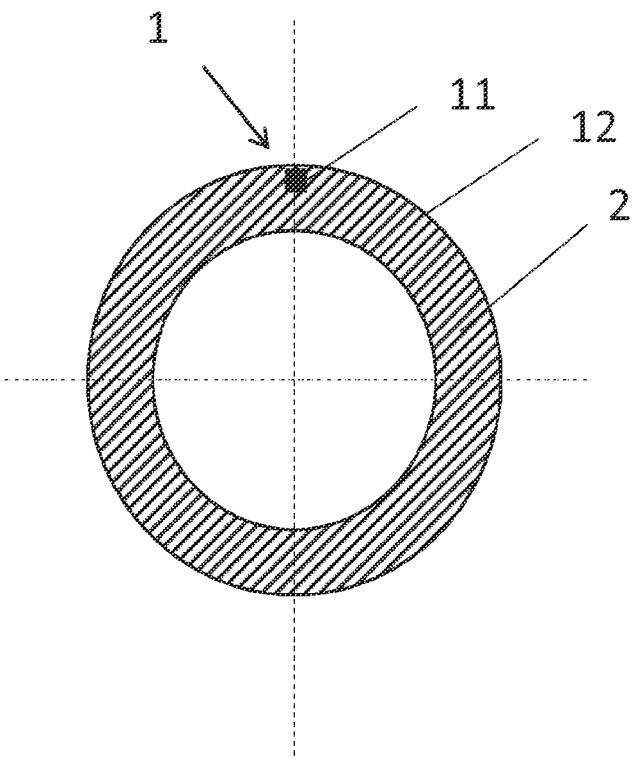
FIG. 1*a* shows a cross-section through the cylinder with a movable stop in the idle position.

FIGS. 1*a* and 1 *b* each show a cross-section through a cylinder 2 with a movable stop 1.

FIG. 1*a* shows the movable stop 1 in an idle position. FIG. 1*b* shows the movable stop 1 in an active position. In the idle position, a pin 11 as a movable element of the movable stop 1 disappears into a recess 10, see also FIGS. 2*a* and 2*b*, in the surface of the cylinder 2 and allows a hollow cylinder to slide over the cylinder. In the active position shown in FIG. 1*b*, the pin 11 of the movable stop 1 protrudes beyond the surface of the cylinder and stops a hollow cylinder in the desired position.

FIG. 2 shows details in a longitudinal section through the movable stop 1. The movable stop 1 is mounted, with a fastening 3, in a recess 10 of the cylinder 2 using connecting elements 5. In the embodiment shown in FIG. 2, the connecting elements 5 are configured as screws which engage in tapped holes 9 in the recess 10. The fastening 3 has an axis of rotation 7 on which the pin 11 is fastened and which allows the pin 11 of the movable stop 1 to be moved from an idle position to an active position and back again.

Figure 2B:
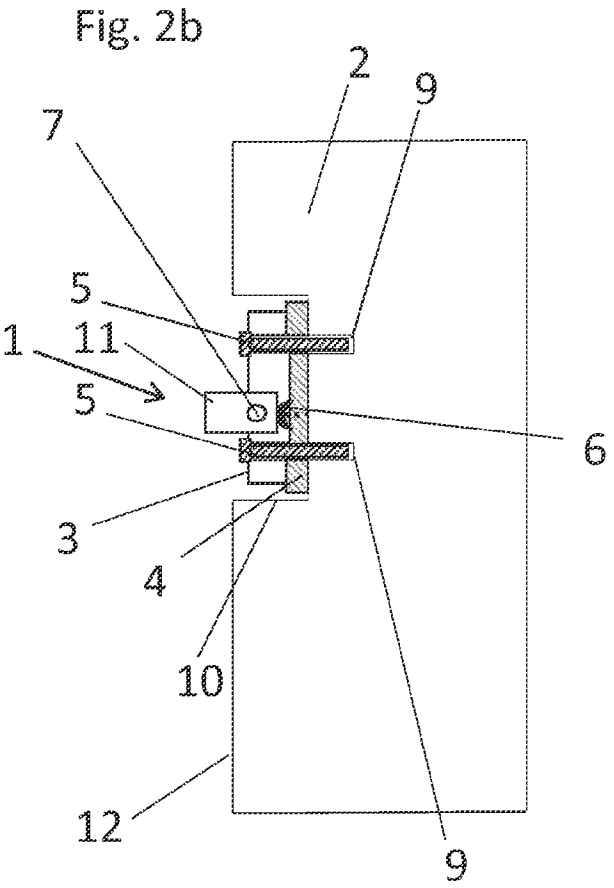
FIG. 2*b* shows a detailed drawing of a longitudinal section of the movable stop in the active position.
Figure 2A:
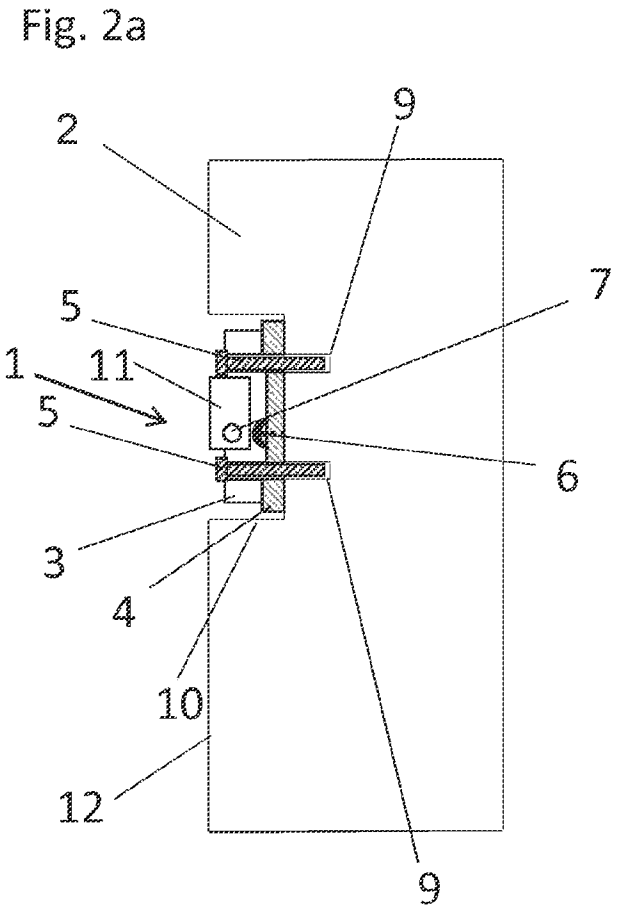
FIG. 2*a* shows a detailed drawing of a longitudinal section of the movable stop in the idle position.

In the embodiment shown in FIGS. 2*a* and 2*b*, the movable stop 1 comprises a positioning part 4 with a locking device 6 which prevents unintentional movement of the pin 11. In the embodiment shown in FIGS. 2*a* and 2*b*, the locking device 6 is configured as a spring-loaded thrust piece located on the positioning part 4. A counterpart in the form of a recess in which the trust piece can engage is located directly at pin 11. In an alternative embodiment, the positioning part 4 can be dispensed with.

Figure 3:
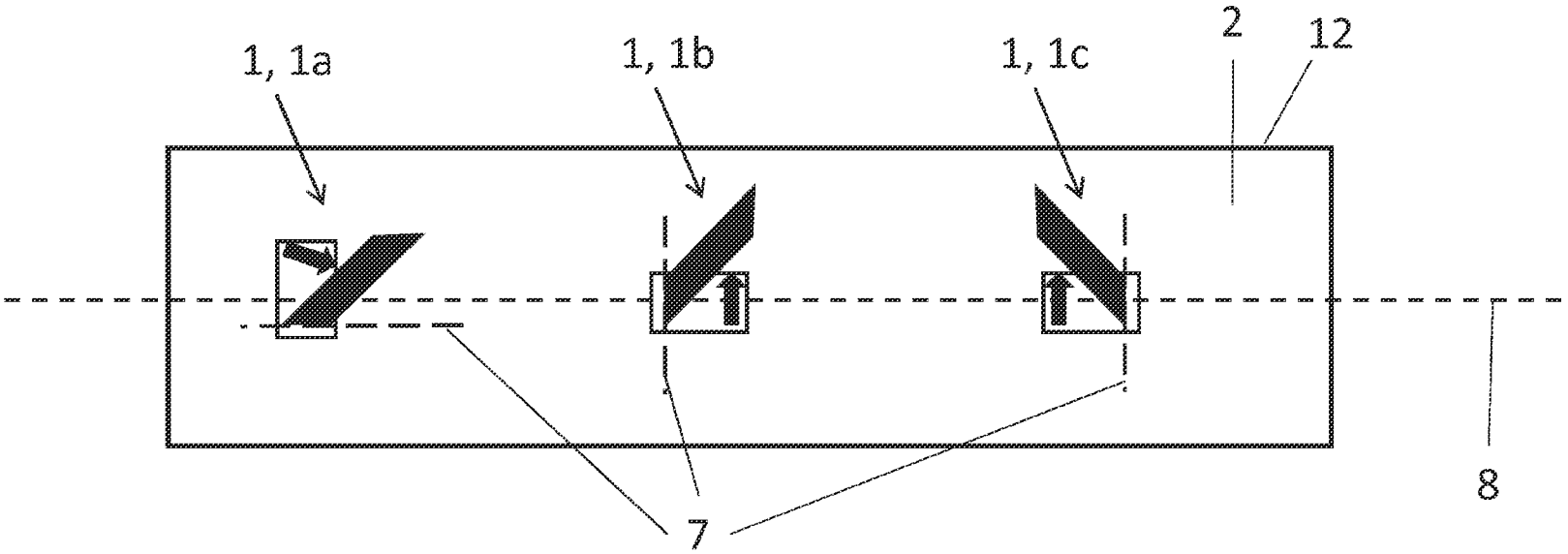
FIG. 3 shows a cylinder with a plurality of movable stops, each with a different arrangement of the axis of rotation of the movable stop.

FIG. 3 shows a cylinder 2 on which, for example, three different movable stops 1 are arranged. The three movable stops 1 are distributed along the length of the cylinder 2 and, in the example shown in FIG. 3, each have different arrangements of the axis of rotation 7. In the case of a first movable stop 1*a*, the axis of rotation 7 is arranged such that it forms an angle of 0° (parallel arrangement) with the longitudinal axis 8 of the cylinder 2. In the case of a second movable stop 1*b* and a third movable stop 1*c*, the respective axes of rotation 7 and the longitudinal axis 8 of the cylinder 2 form an angle of 90° and 270° respectively (perpendicular arrangements). All other angles in between are also possible. If a hollow cylinder is slid on from the left, an arrangement of the axis of rotation 7 at an angle of 270° as with the third movable stop 1*c*) is preferred. An end stop is arranged such that a rotation of the pin 11 beyond a position in which the pin 11 is perpendicular to the surface of the cylinder 2 is not possible. If the hollow cylinder is slid on from the right, an arrangement of the axis of rotation 7 at an angle of 90° as with the second movable stop 1*b* is preferred.

REFERENCES

1 Movable stop
1*a* First movable stop
1*b* Second movable stop
1*c* Third movable stop
2 Cylinder
3 Fastening
4 Positioning part
5 Connecting element, e.g. screws
6 Locking device
7 Axis of rotation
8 Longitudinal axis of the cylinder
9 Tapped hole
10 Recess
11 Pin
12 Outer surface

The invention claimed is:

1. A cylinder arranged to receive one or more hollow cylinders on an outer surface of the cylinder, the cylinder comprising at least one movable stop with at least one movable element, wherein in an idle position, the at least one movable element does not protrude beyond the outer surface of the cylinder and allows the one or more hollow cylinders to be slid over the cylinder, wherein in an active position, the at least one movable element protrudes beyond the outer surface of the cylinder and acts as a mechanical stop for the one or more hollow cylinders, wherein the at least one movable element can be moved from the idle position to the active position, and vice versa, by means of a rotary movement, and wherein during the rotary movement the at least one movable element is rotated around a rotation axis of the at least one movable element.

2. The cylinder of claim 1, wherein the rotation axis of the at least one movable element is perpendicular to a longitudinal axis of the cylinder.

3. The cylinder of claim 1, wherein the cylinder has at least one fixed stop with at least one fixed element protruding beyond the outer surface which acts as a mechanical stop for the one or more hollow cylinders.

4. The cylinder of claim 3, wherein the at least one fixed element is selected from the group consisting of a pin, a raised edge, a segment of a raised edge, a raised ring, and a segment of a raised ring.

5. The cylinder according to claim 3, wherein at least one of: (a) the at least one movable element in the active position, and (b) the at least one fixed element, protrudes beyond the outer surface of the cylinder within a range of 0.1 mm to 100 mm.

6. The cylinder according to claim 3, wherein at least one of: (a) the at least one movable stop comprises two to ten movable elements distributed around the outer surface of the cylinder along a circumferential line, and (b) the at least one fixed stop comprises two to ten fixed elements distributed around the outer surface of the cylinder along a circumferential line.

7. The cylinder according to claim 3, wherein at least two movable stops or at least one fixed stop and one movable stop are arranged on the outer surface distributed along the length of the cylinder.

8. The cylinder according to claim 1, wherein the at least one movable element is selected from the group consisting of a pin, a segment of a raised ring, and as a segment of a raised edge.

9. The cylinder according to claim 1, wherein in the active position, a longitudinal axis of the at least one movable element deviates by less than 30° from an orientation perpendicular to a longitudinal axis of the cylinder.

10. The cylinder according to claim 1, wherein the at least one movable element is made from a material selected from the group consisting of a metal, an alloy, a plastic, a fibre-reinforced plastic, a ceramic, and a glass.

11. The cylinder according to claim 1, wherein the cylinder further comprises at least one locking device which is arranged to fix the at least one movable element in at least one of the active position and the idle position.

12. The cylinder according to claim 11, wherein the at least one locking device comprises a spring-loaded thrust piece which interacts with a counterpart on the at least one movable element.

13. The cylinder according to claim 1, wherein the at least one movable element has a means for pneumatic movement, an electric drive, or means for manual movement.

14. The cylinder according to claim 1, wherein the cylinder is an assembly cylinder for machining hollow cylinders, a plate cylinder, or an adapter cylinder for mounting printing sleeves on a plate cylinder.

15. A method for positioning one or more hollow cylinder on a cylinder according to claim 1, comprising the following steps:

a. providing the cylinder;

b. providing the one or more hollow cylinder;

c. adjusting a selected movable stop by moving at least one movable element of the movable stop into the active position and optionally moving movable elements of non-selected movable stops into the idle position; and d. placing the one or more hollow cylinder on the cylinder, comprising sliding the one or more hollow cylinder over the outer surface of the cylinder until an edge of the one or more hollow cylinder touches at least one movable element of the selected movable stop.

16. An arrangement of cylinders comprising a cylinder and at least one further hollow cylinder arranged on the cylinder, wherein said cylinder has at least one movable stop with at least one movable element, wherein in an idle position, the at least one movable element does not protrude beyond the outer surface of the cylinder and allows the at least one further hollow cylinders to be slid over the cylinder, and in an active position, the at least one movable element protrudes beyond the outer surface of the cylinder and acts as a mechanical stop for the at least one further hollow cylinders, wherein the at least one movable element is movable from the idle position to the active position, and vice versa, by means of a rotary movement, wherein during the rotary movement the at least one movable element is rotated around a rotation axis of the at least one movable element, and wherein at least one edge of the at least one further hollow cylinder touches the at least one movable element in the active position.

17. A method for removing an arrangement of cylinders according to claim 16, wherein the cylinder is arranged to receive one or more hollow cylinders on an outer surface of the cylinder, wherein the method comprises:

a. providing the arrangement of cylinders;

b. removing the at least one further hollow cylinder from the cylinder by sliding the at least one further hollow cylinder off the outer surface of the cylinder; and c. adjusting a selected movable stop by moving at least one movable element of the movable stop to the idle position.

18. A cylinder arranged to receive one or more hollow cylinders on an outer surface of the cylinder and which has at least one movable stop with at least one movable element, wherein in an idle position the at least one movable element does not protrude beyond the outer surface of the cylinder and allows the one or more hollow cylinders to be slid over the cylinder, and in an active position, the at least one movable element protrudes beyond the outer surface of the cylinder and acts as a mechanical stop for the one or more hollow cylinders, wherein the at least one movable element is movable from the idle position to the active position, and vice versa, by means of a rotary movement, and wherein the cylinder further comprises at least one locking device which is arranged to fix the at least one movable element in at least one of the active position and the idle position.

19. The cylinder according to claim 18, wherein the at least one locking device comprises a spring-loaded thrust piece which interacts with a counterpart on at least one movable element.

20. The cylinder according to claim 18, wherein in the active position, a longitudinal axis of the at least one movable element deviates by less than 30° from an orientation perpendicular to the longitudinal axis of the cylinder.

* * * * *